US010998684B2

(12) United States Patent
Chen et al.

(10) Patent No.: US 10,998,684 B2
(45) Date of Patent: May 4, 2021

(54) POWER SUPPLY CONNECTOR

(71) Applicant: Tyco Electronics (Shanghai) Co. Ltd., Shanghai (CN)

(72) Inventors: Shu Chen, Shanghai (CN); Hua Li, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/364,890

(22) Filed: Mar. 26, 2019

(65) Prior Publication Data

US 2019/0305494 A1 Oct. 3, 2019

(30) Foreign Application Priority Data

Mar. 28, 2018 (CN) ..... 201820431736.8

(51) Int. Cl.

| | |
|---|---|
| ***H01R 24/28*** | (2011.01) |
| ***H01R 13/631*** | (2006.01) |
| ***H01R 13/42*** | (2006.01) |
| ***H01R 13/26*** | (2006.01) |
| ***H01R 103/00*** | (2006.01) |

(52) U.S. Cl.

CPC ..... *H01R 24/28* (2013.01); *H01R 13/26* (2013.01); *H01R 13/42* (2013.01); *H01R 13/631* (2013.01); *H01R 2103/00* (2013.01)

(58) Field of Classification Search

CPC .... H01R 24/28; H01R 2103/00; H01R 13/26; H01R 13/42; H01R 13/631

See application file for complete search history.

(56) References Cited

U.S. PATENT DOCUMENTS

| | | | | |
|---|---|---|---|---|
| 8,545,275 | B2 * | 10/2013 | Wang | H01R 24/70 439/693 |
| 8,888,505 | B2 * | 11/2014 | Kobayashi | H01R 12/00 439/74 |
| 9,780,476 | B2 * | 10/2017 | Guo | H01R 24/60 |
| 2012/0077365 | A1 * | 3/2012 | Kobayashi | H01R 13/4223 439/345 |
| 2017/0352968 | A1 * | 12/2017 | Zhang | H01R 24/60 |

* cited by examiner

*Primary Examiner* — Briggitte R. Hammond
(74) *Attorney, Agent, or Firm* — Barley Snyder

(57) ABSTRACT

A power supply connector adapted to be connected to a power supply and a mating electrical connector comprises a housing, a positive conductive terminal positioned in the housing, and a negative conductive terminal positioned in the housing. The positive conductive terminal is electrically connected to a positive wire of the power supply and a mating positive terminal of the mating electrical connector. The positive conductive terminal is positioned between a first surface of a tongue of the housing and a first inner wall of the housing. The negative conductive terminal is electrically connected to a negative wire of the power supply and a mating negative terminal of the mating electrical connector. The negative conductive terminal is positioned between a second surface of the tongue and a second inner wall of the housing.

18 Claims, 4 Drawing Sheets

POWER SUPPLY CONNECTOR

CROSS-REFERENCE TO RELATED APPLICATION

This application claims the benefit of the filing date under 35 U.S.C. § 119(a)-(d) of Chinese Patent Application No. 201820431736.8, filed on Mar. 28, 2018.

FIELD OF THE INVENTION

The present invention relates to a connector and, more particularly, to a power supply connector.

BACKGROUND

Existing high-voltage, for example higher than 110V, AC power systems often require centralized power supply to a plurality of layers of subsystems, especially large-sized or high-power power supply systems such as for Open Computer Projects (OCP). One approach is to connect a power supply in a cabinet using a busbar, such as a thick copper plate, which in turn powers the plurality of layers of subsystems through a plurality of power supply connectors, such as busbar clips.

Because the busbar is usually one piece of thick copper plate, the power supply connectors or busbar clips of the subsystems connected to the busbar need to be connected in a same line to the busbar along the copper plate. Thereby, the whole system is inflexible and requires the surface of the busbar to be smooth, leading to high production costs.

SUMMARY

A power supply connector adapted to be connected to a power supply and a mating electrical connector comprises a housing, a positive conductive terminal positioned in the housing, and a negative conductive terminal positioned in the housing. The positive conductive terminal is electrically connected to a positive wire of the power supply and a mating positive terminal of the mating electrical connector. The positive conductive terminal is positioned between a first surface of a tongue of the housing and a first inner wall of the housing. The negative conductive terminal is electrically connected to a negative wire of the power supply and a mating negative terminal of the mating electrical connector. The negative conductive terminal is positioned between a second surface of the tongue and a second inner wall of the housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
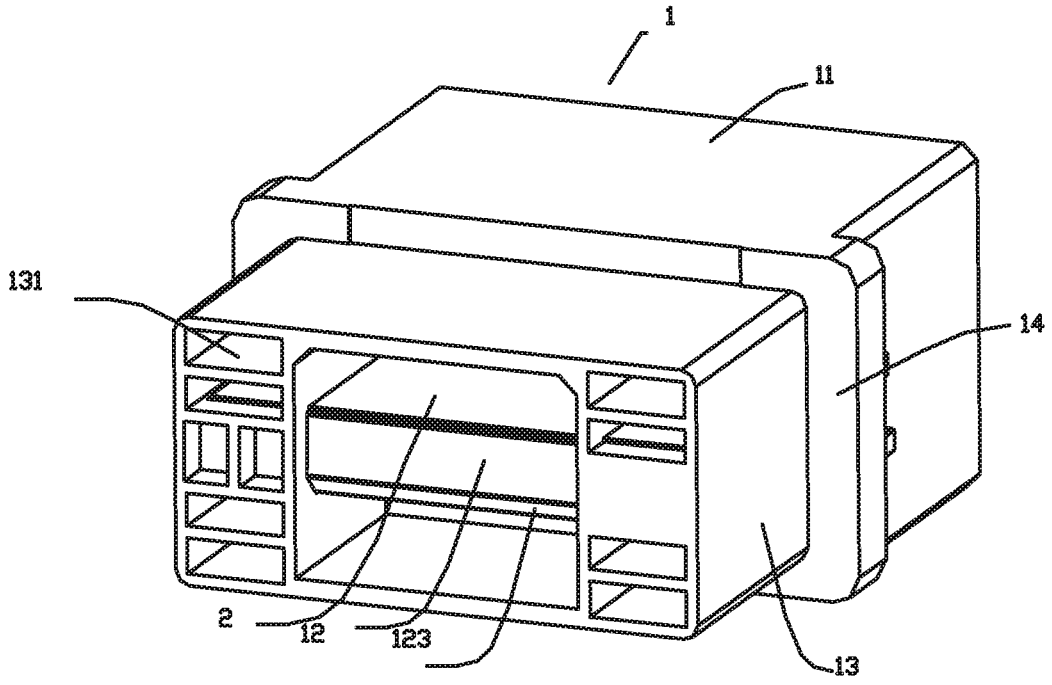
FIG. 1 is a perspective view of a power supply connector according to an embodiment.

Although the present disclosure will be fully described with reference to the embodiments in the accompanying drawings, it should be understood that those skilled in the art may modify the present disclosure described herein while obtaining the technical effects of the present disclosure. The above description is a broad disclosure for those of ordinary skill in the art, and its content is not limited to the exemplary embodiments described in the present disclosure.

In the following detailed description, for ease of explanation, numerous specific details are set forth to provide a comprehensive understanding of the embodiments of the present disclosure. However, one or more embodiments may be practiced without these specific details. In other instances, well-known structures and devices are shown in a schematic form to simplify the drawing.

When powering large-sized or high-power systems, such as servers, high-voltage AC power systems are often used. The term "high-voltage" here refers to an AC voltage higher than 110V, such as an AC voltage of 110V to 220V. In a power supply system, a plurality of power supply connectors are used and are connected to respective subsystems through corresponding mating electrical connectors, thereby enabling simultaneous power supply to a plurality of subsystems.

A power supply connector, as shown in FIGS. 1-8, is adapted to be connected to a power supply, such as a high-voltage AC power supply, and to be connected to a mating electrical connector for a supply of power. The power supply connector comprises a housing 1, a positive conductive terminal 2, and a negative conductive terminal 3. The positive conductive terminal 2 and the negative conductive terminal 3 are both positioned in the housing 1. A first end of the positive conductive terminal 2 is electrically connected to a positive wire of the power supply, and a second end of the positive conductive terminal 2 opposite the first end is electrically connected to a first corresponding conductive terminal, also referred to as a mating positive terminal, of the mating electrical connector. A first end of the negative conductive terminal 3 is electrically connected to a negative wire of the power supply, and a second end of the negative conductive terminal 3 opposite the first end is electrically connected to a second corresponding conductive terminal, also referred to as a mating negative terminal, of the mating electrical connector.

The power supply connector can be used to power the subsystems by respectively flexibly connecting the first ends of the positive conductive terminal 2 and the negative conductive terminal 3 to the positive wire and the negative wire of the power supply, and by simply plugging the second end of the positive conductive terminal 2 and the second end of the negative conductive terminal 3 into the mating electrical connector. This configuration avoids the connection between the power supply connector and a busbar, improving the flexibility of designing and arranging the subsystems, simplifying the operation and saving the cost.

Figure 2:
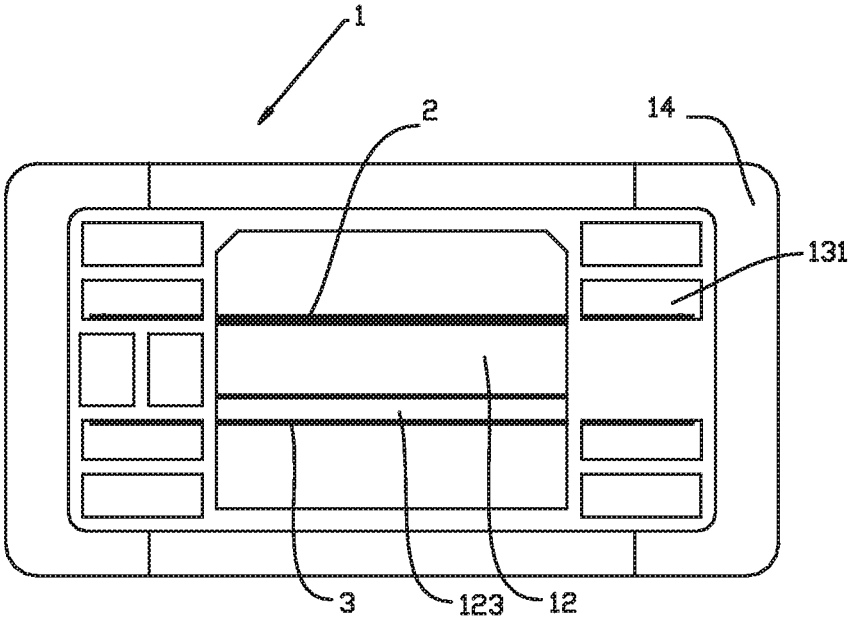
FIG. 2 is a front view of the power supply connector of FIG. 1.
Figure 3:
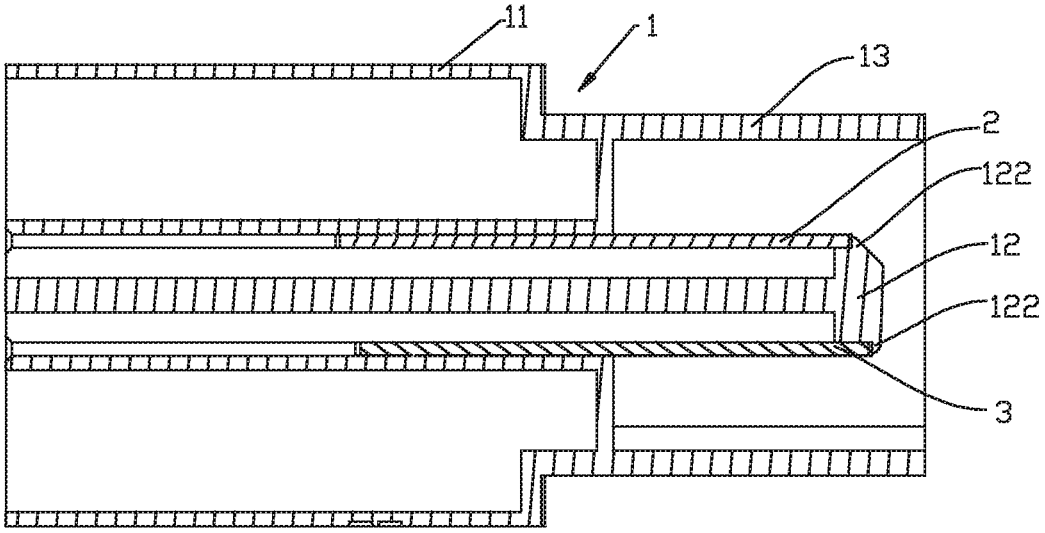
FIG. 3 is a sectional side view of the power supply connector of FIG. 1.

In an embodiment, the housing 1 is an insulation body made of a plastic material. As shown in FIGS. 2 and 3, the positive conductive terminal 2 and the negative conductive terminal 3 each may be formed as a metal sheet, for example, by cutting a metal sheet material. The first end of the positive conductive terminal 2 may be connected to the positive wire of the power supply and one end of the negative conductive terminal 3 may be connected to the negative wire of the power supply; the connections may be achieved in various forms, such as crimping or welding. After the power supply connector is connected with the mating electrical connector, corresponding conductive terminals of the mating electrical connector are respectively in contact with the positive conductive terminal 2 and the negative conductive terminal 3 of the power supply connector, thereby supplying electric energy to desired one of the subsystems by the mating electrical connector.

A power supply connector according to an embodiment is shown in FIGS. 1-4, and a power supply connector according to another embodiment is shown in FIGS. 5-8. However, those skilled in the art will appreciate that the embodiments described herein are exemplary and may be modified by those skilled in the art, and the structures described in the various embodiments can be combined freely without conflicting in structure or principle, thereby realizing more kinds of power supply connectors while solving the technical problems existing in prior arts.

In the embodiment shown in FIGS. 5-8, the power supply connector further comprises a grounding terminal 4 positioned in the housing 1. A first end of the grounding terminal 4 is connected with a grounding end of the power supply, and a second end of the grounding terminal 4 opposite the first end is electrically connected to a mating grounding terminal of the mating electrical connector. The embodiment satisfies the requirements of the three-phase power supply of the subsystems, so that the power supply connector may be applied to a wider range of objects.

As shown in FIGS. 5-8, a pair of opposite sidewalls of the housing 1 have at least one pair of grooves 5 each extending in an insertion direction of the mating electrical connector. Each groove 5 extends in the insertion direction in one of the pair of opposite sidewalls of the housing 1. In an embodiment, at least one of the positive conductive terminal 2, the negative conductive terminal 3, and the grounding terminal 4 is positioned within a corresponding pair of the grooves 5. In the embodiment shown in FIGS. 5 and 6, only the grounding terminal 4 is placed in a pair of grooves 5 in the sidewalls of the housing 1, while the positive conductive terminal 2 and the negative conductive terminal 3 are positioned in other ways. However, in other embodiments, a second pair of grooves or a third pair of grooves may be formed in the opposite sidewalls of the housing 1 so as to position the positive conductive terminal 2 or the negative conductive terminal 3.

The housing 1, as shown in FIGS. 1-8, includes a tongue 12 extending between the two opposite sidewalls of the housing 1 and having a pair of opposite surfaces. In an embodiment shown in FIGS. 3 and 7, the positive conductive terminal 2 is positioned between one of the two opposite surfaces of the tongue 12 and one of a pair opposite inner walls, including an upper inner wall and a lower inner wall, of the housing 1. The negative conductive terminal 3 is positioned between the other of the two opposite surfaces of the tongue 12 and the other of the two opposite inner walls of the housing 1. In an embodiment, the tongue 12 is formed of an insulative material, such as a plastic. In an embodiment, each of the positive conductive terminal 2 and the negative conductive terminal 3 has a planar, sheet-like shape. In an embodiment, the positive conductive terminal 2 and the negative conductive terminal 3 may also be positioned in pairs of grooves 5 in the sidewalls of the housing 1. That is, the positive conductive terminal 2 or the negative conductive terminal 3 may be positioned in various ways, for example, may be positioned between the tongue 12 and the inner wall of the housing 1, or alternatively in the pair of grooves 5 formed in the sidewalls of the housing 1, or both between the tongue 12 and the inner walls of the housing 1 and in the pair of grooves 5 in the sidewalls of the housing 1.

Figure 7:
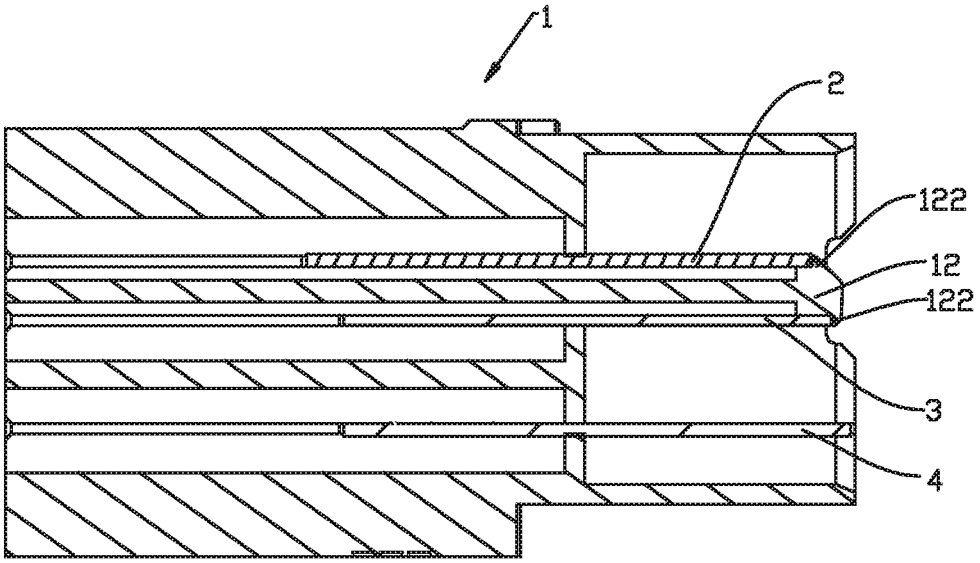
FIG. 7 is a sectional side view of the power supply connector of FIG. 5.
Figure 8:
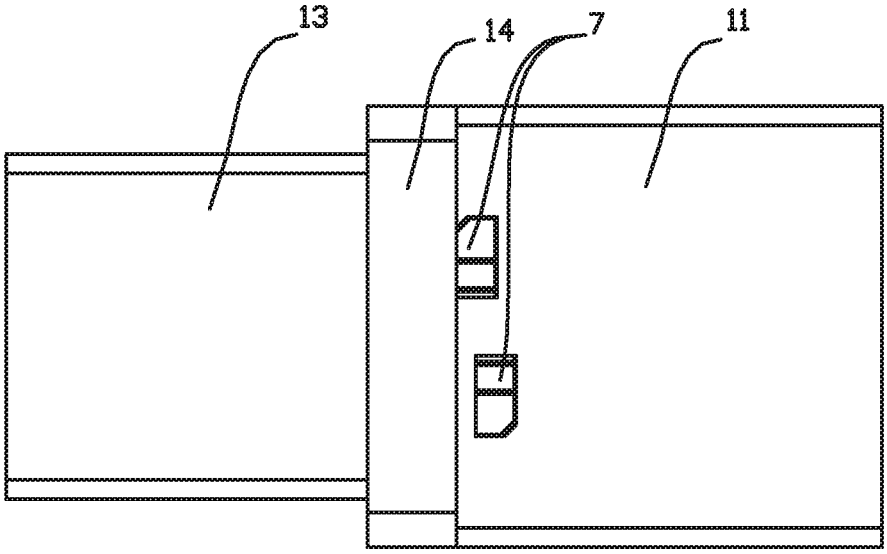
FIG. 8 is a side view of the power supply connector of FIG. 5.

As shown in FIGS. 3 and 7, a first end of the tongue 12 adjacent to the mating electrical connector has a pair of positioning portions 122 respectively protruding perpendicular to the two opposite surfaces of the tongue 12. The positioning portions 122 respectively position a second end of the positive conductive terminal 2 and a second end of the negative conductive terminal 3. When the positive conductive terminal 2 or the negative conductive terminal 3 is inserted into position in the power supply connector, the positioning portions 122 block the end of the positive conductive terminal 2 and the end of the negative conductive terminal 3 from being inserted further, thereby locating the positive conductive terminal 2 and the negative conductive terminal 3 in position.

Figure 4:
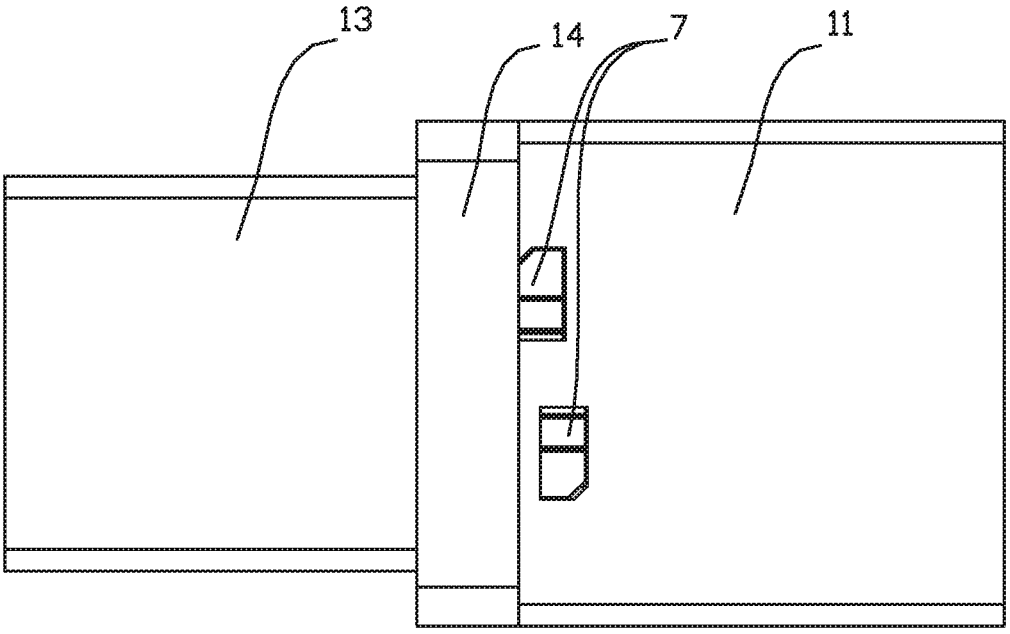
FIG. 4 is a side view of the power supply connector of FIG. 1.

As shown in FIG. 4, at least one holding hole is formed at position/positions of the sidewall of the housing 1 corresponding to the positive conductive terminal 2 and/or the negative conductive terminal 3, and the power supply connector comprises at least one holding member 7 inserted into the holding hole so as to position the positive conductive terminal 2 and/or the negative conductive terminal 3. In the embodiment shown in FIG. 4, two holding members 7 respectively position the positive conductive terminal 2 and the negative conductive terminal 3. In the embodiment shown in FIG. 8, three holding members 7 respectively position the positive conductive terminal 2, the negative conductive terminal 3, and the grounding terminal 4. Various positioning manners may be used in various embodiments. The holding member 7 may be positioned against the edge of any of the positive conductive terminal 2, the negative conductive terminal 3 and the grounding terminal 4. In another embodiment, an indentation may be provided at an edge of any of the positive conductive terminal 2, the negative conductive terminal 3 and the grounding terminal 4, and the corresponding holding member 7 has a flange inserted into the corresponding indentation so as to position any of the positive conductive terminal 2, the negative conductive terminal 3, and the grounding terminal 4.

Figure 5:
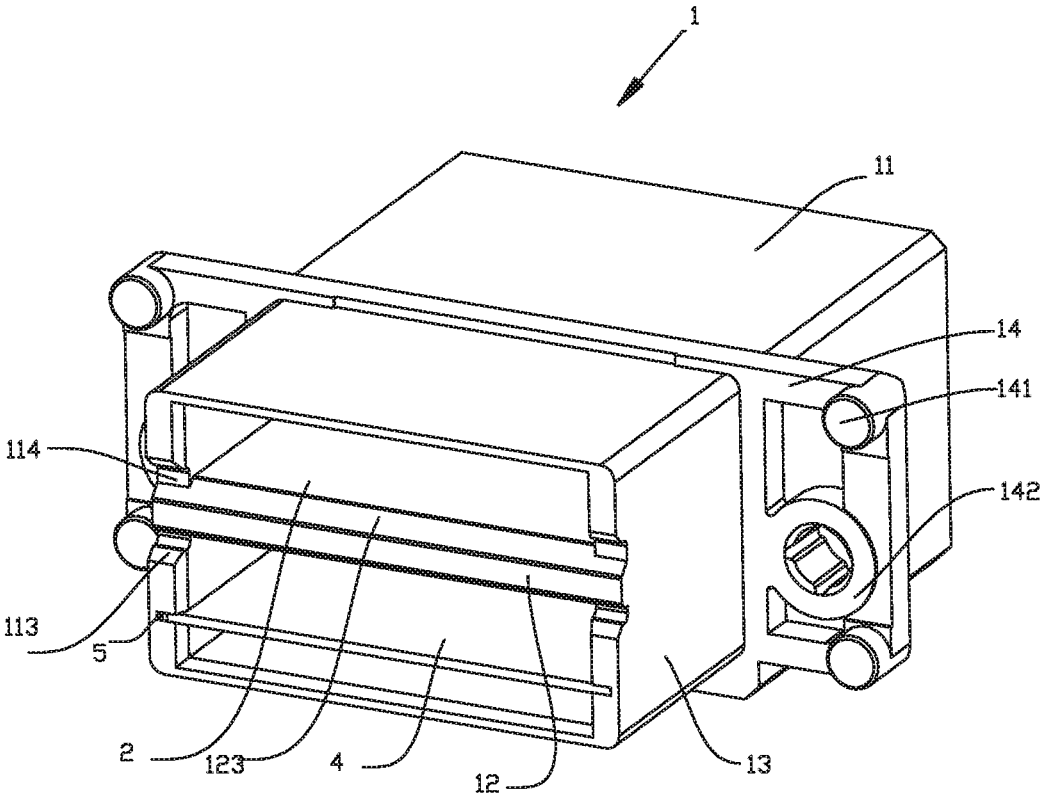
FIG. 5 is a perspective view of a power supply connector according to another embodiment.
Figure 6:
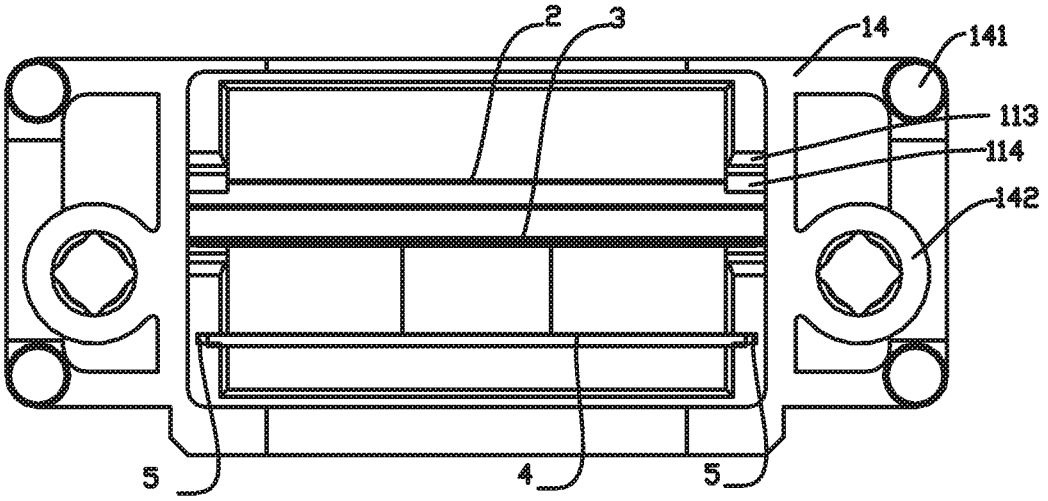
FIG. 6 is a front view of the power supply connector of FIG. 5.

As shown in FIGS. 2 and 5, an end of the tongue 12 adjacent to the mating electrical connector has at least one first inclined guiding surface 123 adapted to guide insertion of the tongue 12 into the mating electrical connector. The tongue 12 may have the first guiding surfaces 123 on both sides thereof or may have the first guiding surface 123 only on one side thereof. When the mating electrical connector is inserted into and mated with the power supply connector, the first guiding surface 123 guides the conductive terminals of the mating electrical connector to contact with the positive conductive terminal 2 and the negative conductive terminal 3, respectively.

The housing 1, as shown in FIGS. 1 and 5, comprises a base 11, a connecting portion 13 extending from the base 11 toward the mating electrical connector, and a flanged portion 14 formed between the base 11 and the connecting portion 13. The connecting portion 13 is adapted to be connected with the mating electrical connector. At least one recess 131 is formed in an end of the connecting portion 13 adjacent to the mating electrical connector so as to cooperate with a corresponding protrusion on the mating electrical connector.

The insertion connection of the power supply connector into the mating electrical connector is guided by the above structure and, thus, the positioning of the power supply connector with respect to the mating electrical connector is achieved. It will be understood by those skilled in the art that the structure of the at least one recess 131 formed in the connecting portion 13 of the power supply connector shown in FIG. 1 may also be applied to the power supply connector shown in FIG. 5.

The flanged portion 14, as shown in the embodiment of FIG. 5, has at least one projection 141 facing toward the mating electrical connector and configured to cooperate with a corresponding notch in the mating electrical connector so as to position the mating electrical connector relative to the power supply connector. It will be understood by those skilled in the art that the structure of the at least one projection 141 formed on the flanged portion 14 of the power supply connector shown in FIG. 5 may also be applied to the power supply connector shown in FIG. 1. In other embodiments, the number of the projections 141 is not limited to the four shown in the embodiment of FIGS. 5 and 6. The flanged portion 14 has at least one cylindrical boss 142 facing toward the mating electrical connector, and an inner fixing hole is formed in the cylindrical boss 142. In an exemplary embodiment shown in FIG. 5, the fixing hole in the cylindrical boss 142 may be a self-tapping screw hole for fixing of the housing 1 of the power supply connector to a corresponding structure on a housing of the mating electrical connector. However, it will be understood by those skilled in the art that the inner hole may also have other shapes, such as a shape of a common threaded hole, so that the housing 1 of the power supply connector may be fixed to the corresponding structure on the housing of the mating electrical connector by screwing a screw into the threaded hole.

As shown in the embodiment of FIG. 5, an end of the housing 1 adjacent to the mating electrical connector has a second inclined guiding surface 113 at a position where the tongue 12 meets with the end of the housing 1, so as to guide insertion of the mating electrical connector. The end of the housing 1 adjacent to the mating electrical connector has a blocking surface 114 at a position where the tongue 12 meets with the end of the housing 1, and the blocking surface 114 is configured to block the mating electrical connector from being further inserted into the power supply connector.

In an embodiment, a power supply system comprises a plurality of the power supply connectors described in any of the above embodiments, the power supply connectors powering a plurality of subsystems.

What is claimed is:

1. A power supply connector adapted to be connected to a power supply and a mating electrical connector, comprising:

a housing having a pair of opposite sidewalls including a pair of grooves extending in an insertion direction of the mating electrical connector into the power supply connector, a pair of opposite inner walls, and a tongue extending between the pair of opposite sidewalls, the tongue having a pair of opposite surfaces;

a positive conductive terminal positioned in the housing, a first end of the positive conductive terminal is configured to be electrically connected to a positive wire of the power supply and a second end of the positive conductive terminal is configured to be electrically connected to a mating positive terminal of the mating electrical connector, the positive conductive terminal is positioned between a first surface of the pair of opposite surfaces of the tongue and a first inner wall of the pair of opposite inner walls of the housing; and a negative conductive terminal positioned in the housing, a first end of the negative conductive terminal is configured to be electrically connected to a negative wire of the power supply and a second end of the negative conductive terminal is configured to be electrically connected to a mating negative terminal of the mating electrical connector, the negative conductive terminal is positioned between a second surface of the pair of opposite surfaces of the tongue and a second inner wall of the pair of opposite inner walls of the housing.

2. The power supply connector of claim 1, further comprising a grounding terminal positioned in the housing, a first end of the grounding terminal is configured to be connected to a grounding end of the power supply and a second end of the grounding terminal is configured to be connected to a mating grounding terminal of the mating electrical connector.

3. The power supply connector of claim 2, wherein at least one of the positive conductive terminal, the negative conductive terminal and the grounding terminal is positioned within the pair of grooves.

4. The power supply connector of claim 1, wherein an end of the tongue adjacent to the mating electrical connector has a pair of positioning portions each protruding perpendicular to the pair of opposite surfaces of the tongue.

5. The power supply connector of claim 4, wherein each of the pair of positioning portions abuts a free end of a respective second end of the positive conductive terminal and the negative conductive terminal for fixing the position of the second end of the positive conductive terminal and the second end of the negative conductive terminal within the housing in a direction opposite the insertion direction of the mating electrical connector.

6. The power supply connector of claim 1, wherein an end of the tongue adjacent to the mating electrical connector has a first inclined guiding surface adapted to guide insertion of the tongue into the mating electrical connector.

7. A power supply connector adapted to be connected to a power supply and a mating electrical connector, comprising:

a housing having:

a pair of opposite sidewalls;

a pair of opposite inner walls;

a tongue extending between the pair of opposite sidewalls, the tongue having a pair of opposite surfaces;

a base;

a connecting portion extending from the base toward the mating electrical connector; and a flanged portion formed between the base and the connecting portions;

a positive conductive terminal positioned in the housing, a first end of the positive conductive terminal is configured to be electrically connected to a positive wire of the power supply and a second end of the positive conductive terminal is configured to be electrically connected to a mating positive terminal of the mating electrical connector, the positive conductive terminal is positioned between a first surface of the pair of opposite surfaces of the tongue and a first inner wall of the pair of opposite inner walls of the housing; and a negative conductive terminal positioned in the housing, a first end of the negative conductive terminal is configured to be electrically connected to a negative wire of the power supply and a second end of the negative conductive terminal is configured to be electrically connected to a mating negative terminal of the mating electrical connector, the negative conductive terminal is positioned between a second surface of the pair of opposite surfaces of the tongue and a second inner wall of the pair of opposite inner walls of the housing.

8. The power supply connector of claim 7, wherein an end of the connecting portion adjacent to the mating electrical connector has a recess adapted to cooperate with a protrusion on the mating electrical connector.

9. The power supply connector of claim 7, wherein the flanged portion has a projection facing the mating electrical connector and configured to cooperate with a notch of the mating electrical connector to position the mating electrical connector with respect to the power supply connector.

10. The power supply connector of claim 7, wherein the flanged portion has a cylindrical boss facing the mating electrical connector, a fixing hole is formed in the cylindrical boss to fix the power supply connector with respect to the mating electrical connector.

11. The power supply connector of claim 1, further comprising a holding member arranged on at least one of the opposite sidewalls and adapted to position the positive conductive terminal or the negative conductive terminal.

12. The power supply connector of claim 6, wherein an end of the housing adjacent to the mating electrical connector has a second inclined guiding surface where the tongue meets with the end of the housing, the second inclined guiding surface adapted to guide insertion of the mating electrical connector into the power supply connector.

13. A power supply connector adapted to be connected to a power supply and a mating electrical connector, comprising:

a housing having a pair of opposite sidewalls, a pair of opposite inner walls, and a tongue extending between the pair of opposite sidewalls, the tongue having a pair of opposite surfaces and defining an end adjacent to the mating electrical connector having a pair of positioning portions each protruding perpendicular from the pair of opposite surfaces of the tongue;

a positive conductive terminal positioned in the housing, a first end of the positive conductive terminal is configured to be electrically connected to a positive wire of the power supply and a second end of the positive conductive terminal is configured to be electrically connected to a mating positive terminal of the mating electrical connector, the positive conductive terminal is positioned between a first surface of the pair of opposite surfaces of the tongue and a first inner wall of the pair of opposite inner walls of the housing; and a negative conductive terminal positioned in the housing, a first end of the negative conductive terminal is configured to be electrically connected to a negative wire of the power supply and a second end of the negative conductive terminal is configured to be electrically connected to a mating negative terminal of the mating electrical connector, the negative conductive terminal is positioned between a second surface of the pair of opposite surfaces of the tongue and a second inner wall of the pair of opposite inner walls of the housing, wherein each of the pair of positioning portions abuts a free end of a respective second end of the positive conductive terminal and the negative conductive terminal for fixing the position of the positive conductive terminal and the negative conductive terminal within the housing in a direction opposite the insertion direction of the mating electrical connector.

14. The power supply connector of claim 13, wherein the positive conductive terminal is supported on an opposing surface of a first one of the pair of positioning portions, the opposing surface of the first positioning portion oriented generally parallel with and adjacent to a first one of the pair of opposite surfaces of the tongue, and wherein the negative conductive terminal is supported on an opposing surface of a second one of the pair of positioning portions, the opposing surface of the second positioning portion oriented generally parallel with and adjacent to a second one of the pair of opposite surfaces of the tongue.

15. The power supply connector of claim 13, wherein the pair of opposite sidewalls of the housing have a pair of grooves extending in an insertion direction of the mating electrical connector into the power supply connector for receiving one of the positive conductive terminal or the negative conductive terminal.

16. The power supply connector of claim 13, wherein an end of at least one of the pair of positioning portions adjacent to the mating electrical connector has a first inclined guiding surface adapted to guide insertion of the tongue into the mating electrical connector.

17. The power supply connector of claim 16, wherein an end of the housing adjacent to the mating electrical connector has a second inclined guiding surface where the tongue meets with the end of the housing, the second inclined guiding surface adapted to guide insertion of the mating electrical connector into the power supply connector.

18. The power supply connector of claim 13, wherein an end of each of the pair of positioning portions adjacent to the mating electrical connector has a first inclined guiding surface adapted to guide insertion of the tongue into the mating electrical connector.

* * * * *